US005429035A

United States Patent [19]

Kaneko et al.

[11] Patent Number: 5,429,035

[45] Date of Patent: Jul. 4, 1995

[54] RODLESS CYLINDER WITH A SPEED CONTROL MECHANISM

[75] Inventors: Kunihisa Kaneko; Yoshisuke Yamashita; Masaharu Kobayashi, all of Yawara, Japan

[73] Assignee: SMC Corporation, Tokyo, Japan

[21] Appl. No.: 285,901

[22] Filed: Aug. 4, 1994

[30] Foreign Application Priority Data

Dec. 9, 1993 [JP] Japan ..... 5-340340

[51] Int. Cl.[6] ..... F15B 15/22

[52] U.S. Cl. ..... 91/26; 91/405; 92/85 B

[58] Field of Search ..... 91/26, 27, 28, 405, 91/406, 407, 408, 409, 451, 452; 92/85 B, 169.1

[56] References Cited

U.S. PATENT DOCUMENTS 1,877,102 9/1932 Whitesell ..... 91/27
2,949,096 8/1960 Ottestad et al. ..... 91/408
3,571,855 3/1971 Hofer et al. ..... 91/405
5,193,433 3/1993 Reimer ..... 91/27

FOREIGN PATENT DOCUMENTS 1017833 5/1983 U.S.S.R. ..... 91/26

*Primary Examiner*—F. Daniel Lopez
*Attorney, Agent, or Firm*—Brumbaugh, Graves, Donohue & Raymond

[57] ABSTRACT

A rodless cylinder with a speed control mechanism comprising a cylinder tube, a hollow cushion ring located at an end of the cylinder tube and adapted to be inserted in a hollow portion of a piston, and a sine function groove formed in the outer surface of the cushion ring, wherein the axial position of said cushion ring is capable of being regulated from the outside of the rodless cylinder, so that the time and magnitude of acceleration and deceleration of the piston can be regulated, as desired.

2 Claims, 5 Drawing Sheets

RODLESS CYLINDER WITH A SPEED CONTROL MECHANISM

BACKGROUND OF THE INVENTION

The present invention relates generally to a rodless cylinder used to operate various machines, and more particularly to a rodless cylinder with a speed control mechanism that enables a piston to be smoothly accelerated at the initial end of the stroke and smoothly decelerated at the terminus of the stroke.

One typical example of such a rodless cylinder is disclosed in JP-A 63-96305. In this rodless cylinder, a piston is slidably inserted in a cylinder tube and a head cover is fixed at either end of the cylinder tube. The piston is provided with a connector which projects outwardly from a slit in the cylinder tube and which is fixedly provided with a table member. End blocks at both ends of the piston are provided with concave portions that are open at said both ends. Within the head cover located at the position opposite to each concave portion there is a columnar form of convex portion (cushion ring) that is fitted into the concave portion. The apex part of the convex portion is provided with a hole in communication with an air feed port, in which hole a check valve is located. In the apex of the concave portion there is a nozzle hole for bypassing the check valve. The head cover is provided with a narrow bypass which is located between the air feed port and the inner portion of the tube that is adjacent to the outer surface thereof, and which is provided with a needle valve.

In the conventional rodless cylinder mentioned above, when the piston is moved to the terminal region of the stroke where the concave portion of the piston is engaged with the convex portion of the head cover, the discharge of air from the check valve is stopped, so that the space surrounding the concave portion is gradually depressurized through the needle valve. By the table member coupled to the piston, load kinetic energy and driving force energy, the air in the exhaust chamber is compressed and pressurized, so that the piston can be decelerated at a given rate. On the other hand, when the piston is positioned at the initial end of the stroke, the amount of the inflowing air is reduced by the needle valve and nozzle, so that the piston can be accelerated at a given rate. However, since the convex portion (cushion ring) is made integral with the head cover, it is impossible to change the time and magnitude of acceleration and deceleration of the piston.

In view of the problem mentioned above, a primary object of the invention is to change the position of the cushion ring and hence the flow rate of air passing around the cushion ring, thereby regulating the time and magnitude of acceleration and deceleration of the piston.

SUMMARY OF THE INVENTION

According to one aspect of the invention, the object mentioned above is achieved by the provision of a rodless cylinder with a speed control mechanism comprising a cylinder tube, a hollow cushion ring located at an end of the cylinder tube and adapted to be inserted in a hollow portion of a piston, and a sine function groove formed in the outer surface of the cushion ring, wherein:

the axial position of said cushion ring is capable of being regulated from the outside of the rodless cylinder.

According to another aspect of the invention, there is a rodless cylinder with a speed control mechanism comprising a cylinder tube, a hollow cushion ring located at an end of the cylinder tube and adapted to be inserted in a hollow portion of a piston, and a sine function groove formed in the outer surface of the cushion ring, wherein:

said cushion ring is built up by fitting a shell ring rotatably over said hollow shaft, said hollow shaft is provided with a sine function groove in the outer surface, said shell ring is provided with an axial slot, and the aperture size of said sine function grooves is varied by changing the angle that said shell ring makes with said hollow shaft.

Upon the piston entering the deceleration region at the terminus of the stroke, the hollow cushion ring at the end of the cylinder tube is inserted into the hollow portion of the piston, the discharged air is regulated by passing between the hollow portion of the piston and the sine function groove, so that the piston can be gradually decelerated. On the contrary, the fed air is regulated in the acceleration region at the initial end of the piston stroke, so that the hollow piston can be gradually accelerated.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the appended claims.

BRIEF DESCRIPTION OF THE DRAWINGS

The present invention will now be described, by way of example but not by way of limitation, with reference to the accompanying drawings, in which.

DETAILED DESCRIPTION OF THE INVENTION

In the following description, the adjectives "large", "intermediate" and "small" are understood to refer to large, intermediate and small diameters.

The first embodiment of the rodless cylinder with a speed control mechanism according to the invention will now be explained at great length with reference to FIGS. 1 and 2.

Figure 1:
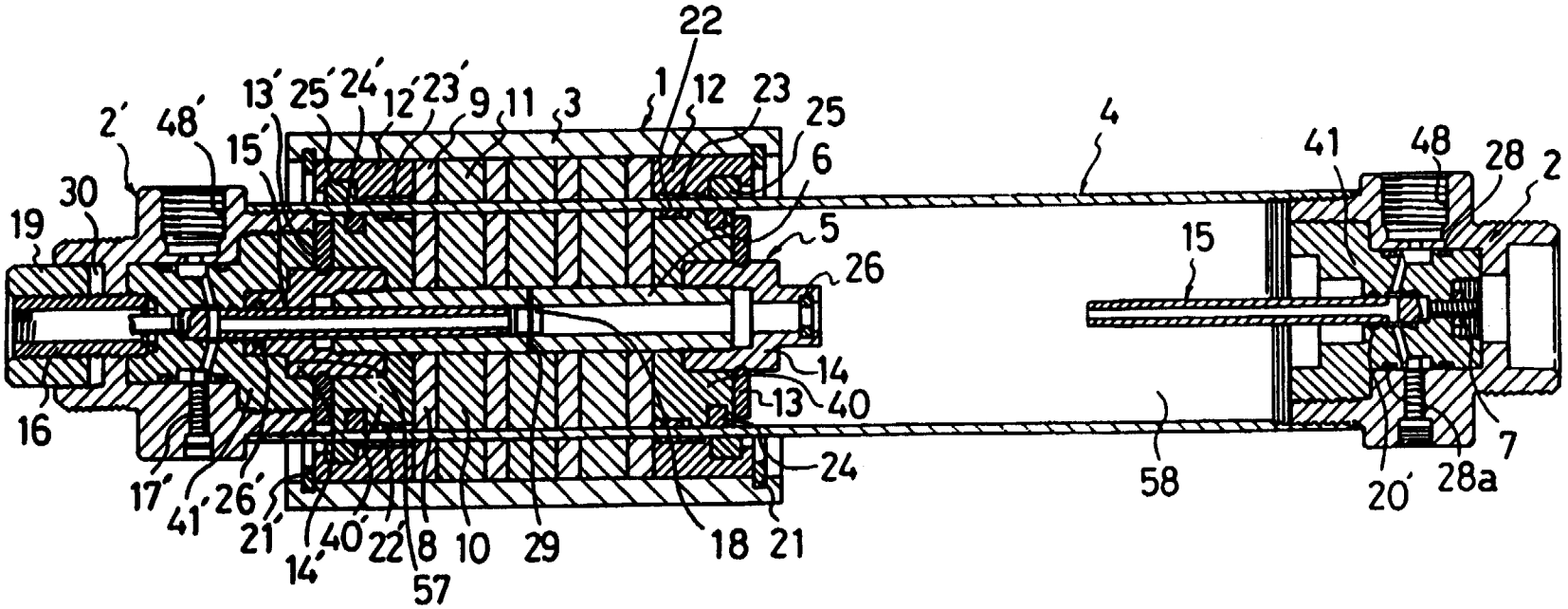
FIG. 1 is a longitudinal section of the first embodiment of the invention.
Figure 2:
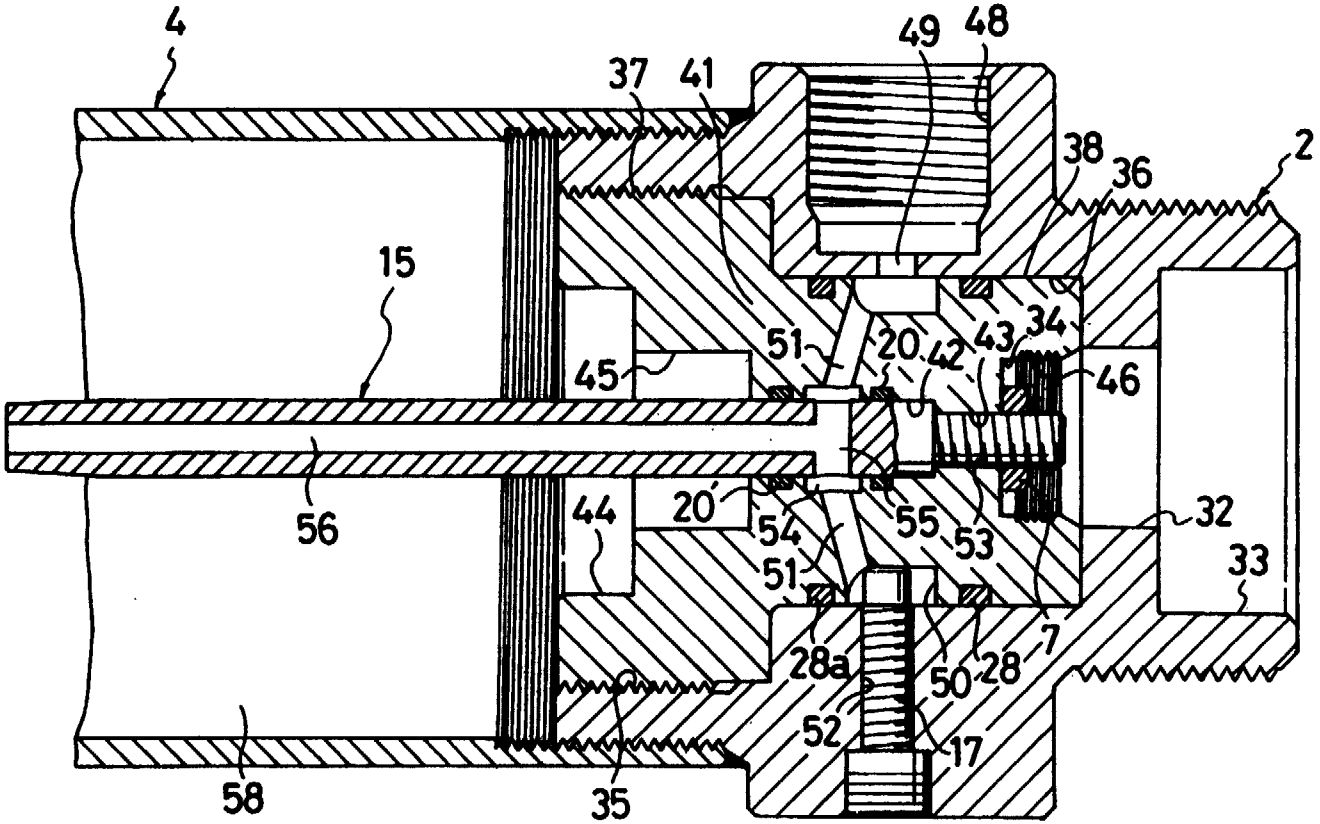
FIG. 2 is a longitudinal section of part of the first embodiment of the invention.

FIG. 1 is a sectional view showing the general structure of the first embodiment, and FIG. 2 is a sectional view showing part of the first embodiment. Head covers 2 and 2' are fixed at both ends of a cylinder tube 4 built up of a non-magnetic material, and a piston 5 is slidably inserted through the cylinder tube 4. At both ends of the piston 5 there are annular end plates 40 and 40' built up of a non-magnetic material, and between the piston end plates 40 and 40' there is an alternate arrangement of yokes 8 and magnets 10 for the piston. A hollow shaft 6 built up of a non-magnetic material is inserted through center holes in the piston end plates 40 and 40', yokes 8 and magnets 10, and is threadedly connected at both its ends with the inner sides of cushion packing holders 14 and 14' that have large diameters, so that the yokes 8, magnets 10 and end plates 40 and 40' are clamped together by the cushion packing holders 14 and 14'. Dampers 13 and 13' are fitted in the outer annular grooves in the cushion packing holders 14 and 14', and cushion packings 26 and 26' are fitted in annular grooves of small diameters in the cushion packing holders 14 and 14'. At a lengthwise intermediate position in the hollow shaft 6 a plug 18 is retained by a pin 29. The plug blocks the axial passage within the hollow shaft and prevents fluid flow between right and left chambers 57 and 58 defined by the piston 5 within the cylinder tube 4. In the left position of the piston 5, the shaft 6 receives a cushion ring 15' affixed to the head cover 2'. In the right position of the piston 5, as described below, the shaft 6 receives a cushion ring 15 affixed to the head cover 2. Each piston end plate 40, 40' has a packing 24, 24', a wear ring 22, 22' and an O-ring (not shown) at its interface with the cylinder tube 4.

An outer moving member 1 is slidably fitted over the cylinder tube 4, and an alternate arrangement of yokes 9 and magnets 11 for the moving member 1 is provided inside a non-magnetic body 3 forming the moving member 1. On both sides of the alternative arrangement there are located wear ring holders 12 and 12'. Between the magnets 11 and 10 for the moving member 1 and piston 5 there is mutual attraction, with the magnets 11 and 10 having the same thickness and the yokes 9 and 8 for the moving member 1 and piston 5 having the same thickness as well. Stop rings 21 and 21' are fitted in inner annular grooves in both ends of the magnetic body 3, and wear rings 23 and 23' and scrapers 25 and 25' are mounted on the wear ring holders 12 and 12'. The outer moving member 1 of the structure mentioned above follows the movement of the piston 5 due to inter-magnet attraction.

The right and left head covers 2 and 2' are of the same internal structure; explanation will now be given primarily with reference the right head cover 2 shown in FIG. 2. The head cover 2 has a stepped bore which, in order from the cylinder tube 4, is made up of a large hole 35, an intermediate hole 36, a small hole 32 and a threaded hole 33, said large hole 35 being provided with an internal thread. As shown, a cushion ring holder 41 has large and small portions 37 and 38, the latter of which is fitted into the intermediate hole 36 in the head cover 2. Then, the externally threaded large portion 37 of the cushion ring holder 41 is threadedly engaged with internally threaded large hole 35 in the head cover 2. The cushion ring holder 41 is provided on one side, i.e., the side facing the cylinder tube 4, with a stepped bore made up of large and intermediate holes 44 and 45, and on the other side with a threaded hole 46. Between the intermediate hole 45 and threaded hole 46 in the cushion ring holder 41 there are formed a hole 42 and a threaded hole 43. A communication passage 51 is formed between the hole 42 and an annular groove 50 provided in the outer surface of the small portion 38 of the cushion ring holder 41. On both sides of the annular groove in the small portion 38 of the cushion ring holder 31 there are provided annular grooves for receiving 0rings 28 and 28*a*. The head cover 2 (2') is radially provided with a port 48 (48') and a threaded hole 52, said port 48 communicating with the annular groove 50 via a communication hole 49, and said threaded hole 52 receiving a stopper bolt 17 (17') until its leading end urges the bottom of the annular groove 50, so that the cushion ring holder 41 (41') is kept from rotation. An adjust screw 16 (see FIG. 1) having a hexagonal hole is threadedly engaged with an end face of the threaded hole 46 in the cushion ring holder 41' (see FIG. 1), optionally with the application of an adhesive as detent means. The position of engagement of the damper 13' (see FIG. 1) of the piston 5 with the large portion of the cushion ring holder 41 is varied by inserting a hexagonal wrench into the hexagonal hole 34 to turn the cushion ring holder 41, so that the stroke of the piston 5 can be adjusted. After the position of the cushion ring holder 41 is regulated, the stopper bolt 17 (17') is screwed into the threaded hole 52 until the annular groove 50 is clamped by the leading end of the bolt 17 (17'), so that the cushion ring holder 41 can be fixed in place. Where tighter fixation is needed, a spring washer 30 and a lock nut 19 may be used to clamp the adjust screw 16 more tightly.

The hollow cushion ring 15 is made up of a large portion which is fitted into the hole 42, and a small threaded portion 53 which is threadedly engaged within the threaded hole 43 in the cushion ring holder 41. The cushion ring holder 41 is provided in the portion where the communication passage 51 is open in the hole 42 with an annular groove 54, which in turn communicates with a transverse hole 55 in the cushion ring 15. O-rings 20 and 20' are fitted into annular grooves formed on both sides of an annular groove 54 in the hole 42. The large portion of the cushion ring 15 is provided with an axial bore 56 with the leading end being open at the cushion-entrance end (the left end in FIG. 2) of the cushion ring 15 and the trailing end communicating with the transverse hole 55. On the outer surface of the large portion of the cushion ring 15 there is a sine function groove (not shown but similar to sine function grooves 81 and 82 shown in FIG. 4C) with a variation in the depth with respect to the axial direction. It is here noted that the depth of the sine function groove reaches a maximum on the cushion-entrance side, and decreases as the stroke end is reached. At the rear end (the right end in FIG. 2) of the cushion ring 15 there is a width-across-flats portion such that the cushion ring 15 can be turned by engaging an exclusive jig with this portion. Since the threaded portion 53 is in threaded engagement with the threaded hole 43, the cushion ring 15 is axially moved by the turning of the cushion ring 15, so that the stop position of the piston 5 can be regulated. Following this, a lock nut 7 is screwed onto the threaded portion 53 with an adhesive (e.g., Locktight 262) applied on it. Alternatively, this may be achieved by engaging the lock nut 7 with the hexagonal hole of the adjust screw 16 after the completion of the regulation, turning the adjust screw 16 to engage the lock nut 7 with the threaded portion 53, fitting a spring washer 30 over the cushion ring holder 16, and threadedly engaging a lock nut 19 onto the threaded hole 33.

Reference will now be made to how the first embodiment of the invention works.

Where the piston 5 is located at the left end shown in FIG. 1, driving air enters the left piston chamber 57 via the port 48', the communication passage 51 in the cushion ring holder 41', the axial bore and transverse hole in the cushion ring 15' and the gap between the cushion packing 26' and the sine function groove in the outer surface of the cushion ring 15', generating driving force for the piston 5. The air is discharged from the right piston chamber 58 through the axial bore 56 and transverse hole 55 in the cushion ring 15, the communication passage 51 and annular groove 50 in the cushion ring holder 41, the communication hole 49 and the port 48. Upon the pressure in the left piston chamber 57 exceeding the actuation pressure for the piston 5, the piston 5 starts moving in the right direction and, with this movement, the gap between the cushion packing 26' and the sine function groove in the outer surface of the cushion ring 15' becomes gradually wide (deep), so that the amount of the driving air fed to the left piston chamber 57 can increase gradually; that is, the driving force can increase to accelerate the piston 5 slowly. Thus, the amount of the driving air fed increases gradually due to the sine function groove that prevents any sharp change in volume expansion (speed) due to the velocity of the piston 5. Upon the cushion packing 26' disengaging itself from the cushion ring 15' by the rightward movement of the piston 5, the piston 5 is normally driven.

With the cushion packing 26 of the piston 5 engaged with the cushion ring 15, the air is discharged from the right piston chamber 58 through the gap between the cushion ring 26 and the sine function groove in the outer surface of the cushion ring 15, the axial bore 56 and transverse hole 55 in the cushion ring 15, the communication passage 51, annular groove 50 and communication hole 49 in the cushion ring holder 41, and the port 48 in the head cover 2. Since the sine function groove in the outer surface of the cushion ring 15 is deep on the cushion-entrance side, a large amount of air is discharged at the initial time of entrance of the cushion packing 26 in the cushion ring 15, so that no sharp brake can be put on the piston 5. Then, as the piston 5 moves, the gap between the cushion packing 26 and the sine function groove in the outer surface of the cushion ring 15 becomes gradually narrow (shallow), so that the amount of air discharged from the right piston chamber 58 can be reduced. Consequently, the piston 5 is gradually decelerated with no sharp brake put on, and reaches the stroke end. In some cases, no desired deceleration is obtained due to an accuracy variation of the sine function grooves in the cushion rings 15 and 15' and a dimensional variation of related parts. Any desired deceleration is then achievable by regulating the positions of the cushion rings 15 and 15', as mentioned above.

Figure 3:
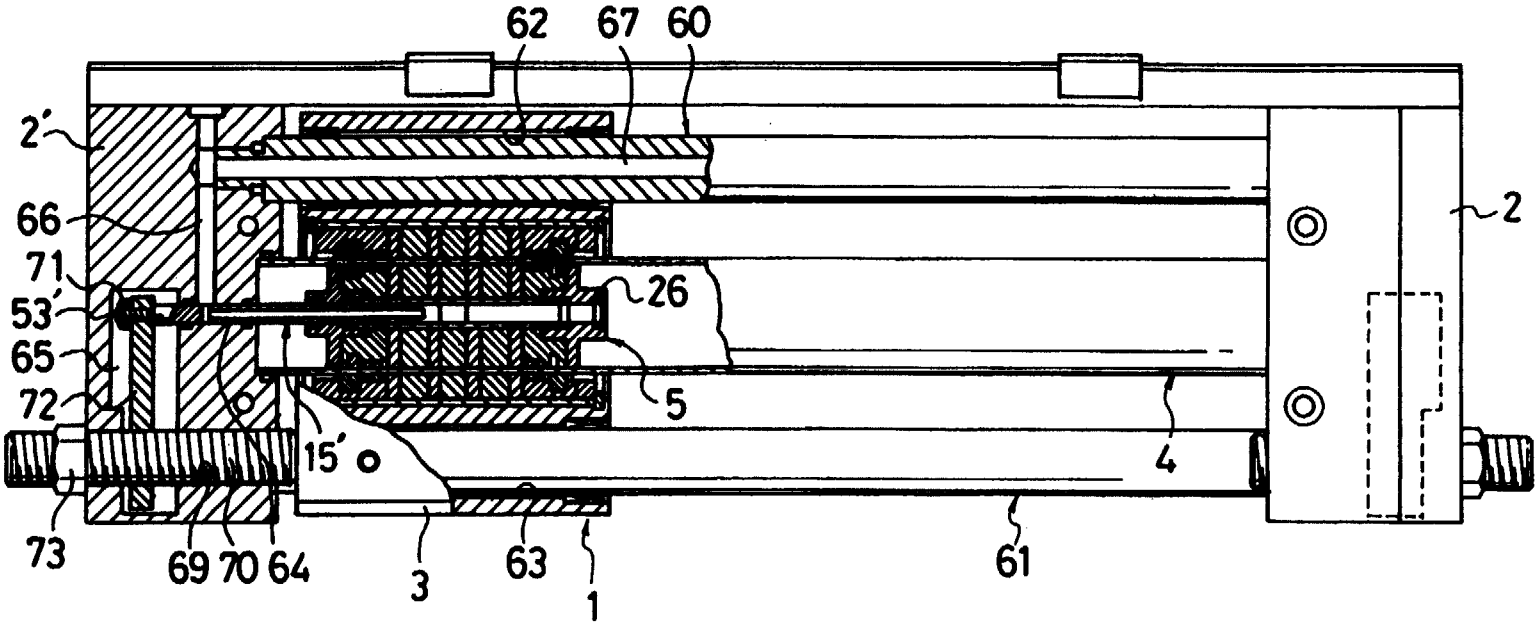
FIG. 3 is a longitudinal section of the second embodiment of the invention, FIG. 4(*a*) is a top view of part of the third embodiment of the invention, FIG. 4(*b*) a sectional view of part of the third embodiment of the invention, FIG. 4(*c*) a side view of the hollow shaft in the third embodiment of the invention.

The second embodiment of the rodless cylinder with a speed control mechanism according to the invention will now be explained with reference to FIG. 3. The same parts as in the first embodiment are indicated by the same reference numerals as in the first embodiment, and so are briefly explained.

Head covers 2 and 2' are fixed at both ends of a cylinder tube 4, and between the head covers 2 and 2' there are connected two guide rods 60 and 61 which are substantially located in parallel with the cylinder tube 4. A piston 5 used in the second embodiment is of the same structure as the piston 5 of the first embodiment. An outer moving member 1 used in the second embodiment, too, is the same structure as the outer moving member 1 of the first embodiment with the exception of the structure of a nonmagnetic body 3. The non-magnetic body 3 is provided on both its sides with slots 62 and 63 for receiving the guide rods 60 and 61. More exactly, after bearings are fitted in annular grooves in the slots 62 and 63, the guide rods 60 are 61 are inserted through them. At the left side portion of the head cover 2' there is formed in a recess 65 which extends (down in FIG. 3) from the middle portion to one side. On a center line of the cylinder tube 4 there is provided a slot 64 that connects the recess 65 with the cylinder tube 4. Within the guide rod 60, there is a passage 67 that communicates with the slot 64 via a communication passage 66.

On one side of the head cover 2' there is provided a threaded hole 69 in parallel with the cylinder tube 4. A stopper bolt 70 is threadedly engaged within the thread hole 69, and is engaged at the right end with the nonmagnetic body 3 of the outer moving member 1. A cushion ring 15' of the same structure as the cushion ring 15' of the first embodiment is inserted into the slot 64, and a threaded portion 53' of the cushion ring 15' is fitted into a hole in a connector 72 for engagement with a nut 71. The stopper bolt 70 is threadedly engaged within one threaded hole in the connector 72 such that the cushion ring 15' can be axially moved by the turning of the stopper bolt 70 through the connector 72. As in the case of the first embodiment, the acceleration and deceleration of the piston 5 are observed after assembling for the fine regulation of the position of the cushion ring 15', thereby enabling the piston 5 to be accelerated or decelerated as desired. The action of the second embodiment is the same as that of the first embodiment with the exception of the means for regulating the position of the cushion ring 15'.

Figure 4A:
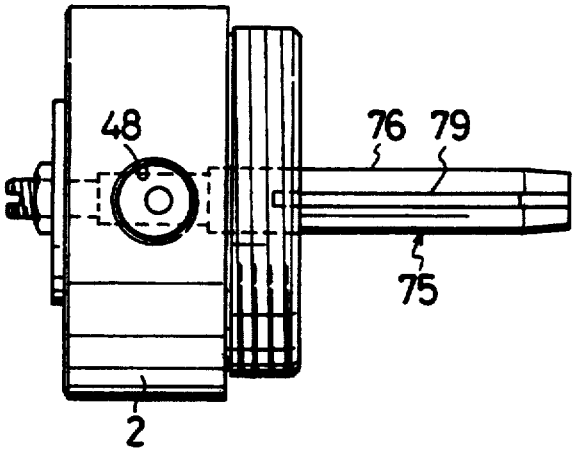
Figure 4B:
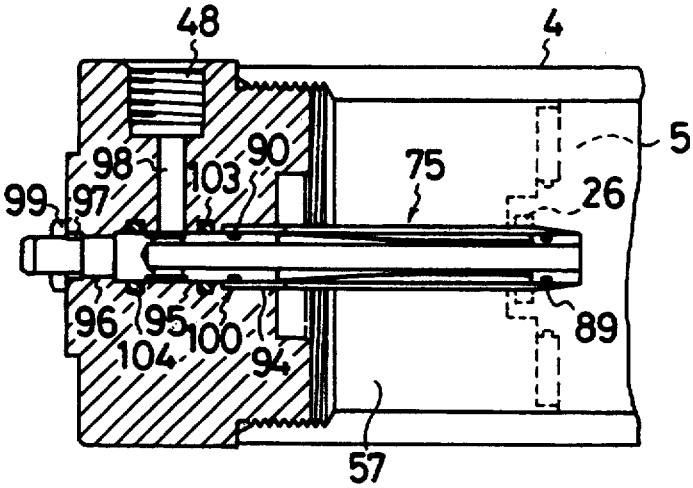
Figure 4C:
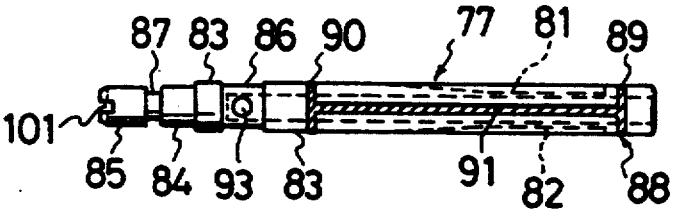
Figure 5A:
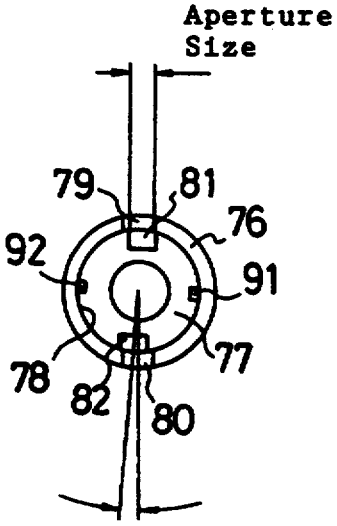
FIG. 5 is a view showing the angle of rotation of the hollow shaft and the aperture size of the axial groove in the shell ring in the third embodiment of the invention.
Figure 5B:
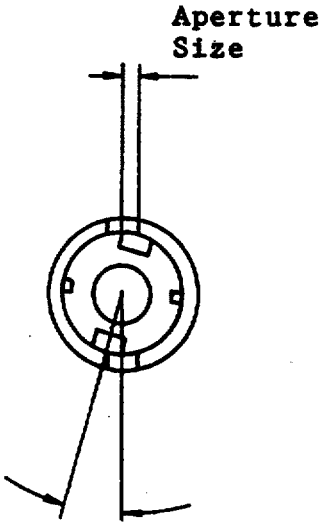
Figure 5C:
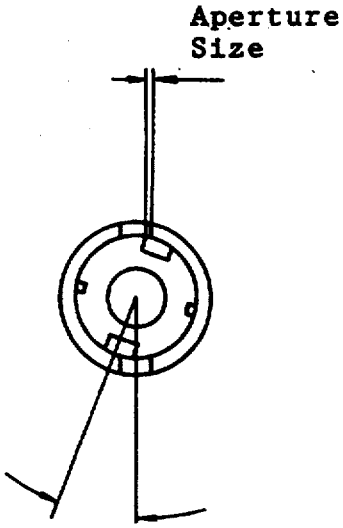

The third embodiment of the rodless cylinder with a speed control mechanism according to the invention will now be explained with reference to FIGS. 4 and 5. Part of the third embodiment is illustrated in FIG. 4, in which the same parts as in the first embodiment are indicated by the same reference numerals as in the first embodiment.

In the third embodiment, a cushion ring 75 is made up of two members, i.e., a shell ring 76 and a hollow shaft 77. The hollow shaft 77 is rotatably inserted through a bore 78 of the shell ring 76. The shell ring 76 is provided in the outer surface with axial slots 79 and 80 with an angle difference of 180 degrees. The hollow shaft 77 is provided with a large portion 83, an intermediate portion 84 and a threaded portion 85 in order from the leading end (the right end in FIG. 4). The large portion 83 is provided with an annular groove 86 in the rear end, and between the intermediate and threaded portions 84 and 85 there is formed an annular escape groove 87. On the outer surface of the hollow shaft 77 there are sine function grooves 81 and 82 which are substantially of the same length as the axial slots 79 and 80 and are located with an angle difference of 180 degrees. The sine function grooves 81 and 82 have their depth variable according to a sine function ($\sin^2 \alpha$), and are of constant width. On the outer surface of the hollow shaft 77 annular grooves are formed on both axial sides of the sine function grooves 81 and 82, between which there are formed axially linear grooves that are located with a phase difference of about 90 degrees relative to the sine function grooves 81 and 82. A three-dimensional seal 88 obtained by connecting two annular portions 89 and 90 with two linear portions 91 and 92 with a phase difference of about 180 degrees is provided. Then, the annular portions 89 and 90 of the seal 88 are fitted into the two annular grooves in the outer surface of the hollow shaft 77, while the linear portions 91 and 92 of the seal 88 are fitted in the two linear grooves in the outer surface of the hollow shaft 77. Within the hollow shaft 77 there is formed a shaft communication hole 93 for connecting the leading end with the annular groove 86. The cushion ring 75 is assembled by fitting the shell ring 76 rotatably in the hollow shaft 77 while the sine function grooves 81 and 82 in the hollow shaft 77 are superposed on the axial slots 79 and 80 in the shell ring 76.

The head cover 2 has a centrally located, axially extending stepped bore 100, which, in order from the cylinder tube 4 (the right side thereof in FIG. 4), is made up of a large hole 94, an intermediate hole 95, a small hole 96 and a threaded hole 97. The cushion ring 75 is inserted into the stepped bore 100 of the head cover 2 through the cylinder tube 4, and the shell ring 76 of the cushion ring 75 is press fitted or otherwise fixed in the large hole 94. Upon the threaded portion 85 of the hollow shaft 77 screwed into the threaded hole 97 in the stepped bore 100, the rear end (the left end in FIG. 4) of the large portion 83 of the hollow shaft 77 is engaged with the rear end of the intermediate portion 95 of the stepped bore 100. Within the head cover 2 there is formed a communication passage 98 for establishing communication between the intermediate portion 95 of the stepped bore 100 and the port 48, which in turn communicates with the left piston chamber 57 of the cylinder tube 4 via the annular groove 86 and shaft communication hole 93 in the hollow shaft 77. On both sides of the opening of the communication passage 98 in the intermediate portion 95 of the stepped bore 100 there are formed annular grooves, which in turn receive annular seals 103 and 104 to provide a seal between the intermediate portion 95 of the stepped bore 100 and the large portion 83 of the hollow shaft 77. A three-dimensional seal 88 is provided between the shell ring 76 and the hollow shaft 77, thereby allowing the sine function grooves 81 and 82 to communicate with the axial slots 79 and 80 alone. The hollow shaft 77 is provided at the rear end (the left end in FIG. 4) with an axial slot 101, within which a suitable tool such as a screw driver is engaged to turn the hollow shaft 77. As can be seen from FIG. 5, the rotation of the hollow shaft 77 causes the angle $\beta$ that the axial slots 79 and 80 make with the sine function grooves 81 and 82 to vary, so that the aperture size of the sine function grooves 81 and 82 varies; there is a change in the amount of air passing between the cushion packing 26 of the piston 5 and the sine function grooves 81 and 82, when the cushion packing 26 is engaged with the cushion ring 75. Consequently, the acceleration and deceleration of the piston 5 can be regulated by the rotation of the hollow shaft 77. After this regulation is done, the lock nut 99 is threadedly engaged with the threaded portion 85 of the hollow shaft 77 for the fixation of the hollow shaft 77.

Reference will now be made to how the third embodiment of the invention works. In order to move the piston 5 in the right direction, driving air is allowed to enter the piston 5 through the port 48, the communication passage 98 and the annular groove 86 and shaft communication hole 93 in the hollow shaft 77 of the cushion ring 75, then enter the axial slots 79, 80 and sine function grooves 81, 82 through the outer opening of the cushion ring 75, and finally enter the left piston chamber 57 through between the cushion packing 26 and the axial slots 79, 80 and sine function grooves 81, 82, and the outer opening of the cushion ring 75, thereby generating driving force for the piston 5. The air is discharged from the right piston chamber through a passage (not shown). Upon the pressure of the left piston chamber 57 exceeding the actuation pressure for the piston 5, the piston 5 starts moving in the right direction and, with the movement of the piston 5, the depths of the sine function grooves 81 and 82 gradually increase. Then, since there is a gradual increase in the amount of the driving air fed to the left piston chamber 57, the driving force is further increased, so that the piston 5 can be gradually accelerated. This acceleration can be determined by the angle $\beta$ that the axial slots 79 and 80 make with the sine function grooves 81 and 82; acceleration regulation can be achieved by changing the angle $\beta$, as shown in FIGS. 5(*a*) to (*c*). Upon the cushion packing 26 disengaging itself from the cushion ring 75 by the rightward movement of the piston 5, the piston 5 is normally driven.

In order to move the piston 5 in the left direction, the driving air is fed in the direction opposite to that mentioned above. Deceleration regulation may also be achieved in the same manner as in the case of acceleration regulation. These regulations may be achieved by unclamping the lock nut 99, turning the hollow shaft 77, determining the aperture size shown in FIG. 5, and clamping the lock nut 99.

According to the present rodless cylinder with a speed control mechanism wherein the axial position of the cushion ring can be regulated from the outside thereof, it is possible to start decelerating the piston at any desired position until it is stopped at any desired position and accelerate it at any desired position, even when the cushion ring and related parts are found to have low accuracy and some dimensional errors after the rodless cylinder is built up.

According to the present rodless cylinder with a speed control mechanism wherein the cushion ring is built up by fitting the shell ring rotatably over the hollow shaft, the hollow shaft is provided with a sine function groove in the outer surface, the shell ring is provided with an axial slot, and the aperture size of said sine function grooves is regulated by changing the angle that said shell ring makes with said hollow shaft, it is possible to change the angle that the shell ring makes with the hollow shaft from the outside thereof, thereby regulating the aperture size of the sine function groove and so achieving the acceleration and deceleration of the piston as desired, even when the cushion ring and related parts are found to have low accuracy and some dimensional errors after the rodless cylinder is built up.

While the invention has been described with reference to some preferable embodiments, it is understood that many changes and modifications may be possible within the scope of the invention indicated in the claims.

What is claimed is:

1. A rodless cylinder with a speed control mechanism comprising a cylinder tube, a hollow cushion ring located at an end of the cylinder tube and adapted to be inserted in a hollow portion of a piston, and a sine function groove formed in the outer surface of the cushion ring, wherein:

an axial position of said cushion ring is capable of being regulated from outside of the rodless cylinder.

2. A rodless cylinder with a speed control mechanism comprising a cylinder tube, a hollow cushion ring located at an end of the cylinder tube and adapted to be inserted in a hollow portion of a piston, wherein:

said cushion ring is built up by fitting a shell ring rotatably over a hollow shaft, and said hollow shaft is provided with a sine function groove in an outer surface, said shell ring is provided with an axial slot, and an aperture size between said axial slot and said sine function groove is varied by changing an angle that said shell ring makes with said hollow shaft.

* * * * *